US006789914B1

(12) United States Patent
Brown et al.

(10) Patent No.: US 6,789,914 B1
(45) Date of Patent: Sep. 14, 2004

(54) LUMINAIRE PROVIDING DIRECT AND INDIRECT LIGHTING

(75) Inventors: Ray A. Brown, Spokane, WA (US); Martin C. Werr, Spokane, WA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/447,304

(22) Filed: May 29, 2003

(51) Int. Cl.[7] ..... F21S 8/02

(52) U.S. Cl. ..... 362/147; 362/225; 362/346; 362/342

(58) Field of Search ..... 362/217, 260, 362/225, 223, 307, 147, 148, 364, 365, 347, 346, 243, 296, 297, 298, 342, 290, 354, 247

(56) References Cited

U.S. PATENT DOCUMENTS

| | | | | |
|---|---|---|---|---|
| 3,591,798 A | | 7/1971 | Florence | |
| 3,777,135 A | * | 12/1973 | Rees | 362/225 |
| 4,238,815 A | * | 12/1980 | Price | 362/218 |
| 4,517,631 A | | 5/1985 | Mullins | |
| 4,728,993 A | * | 3/1988 | Hilgers | 355/70 |
| 4,751,626 A | * | 6/1988 | Plewman | 362/346 |
| 5,528,478 A | | 6/1996 | Degelmann | |
| 5,685,633 A | | 11/1997 | Engel | |
| 5,709,460 A | | 1/1998 | Lester | |
| 5,873,646 A | * | 2/1999 | Fjaestad et al. | 362/92 |
| 5,884,994 A | | 3/1999 | Herst et al. | |
| 5,921,666 A | * | 7/1999 | Preston et al. | 362/341 |
| 5,988,829 A | | 11/1999 | Holder | |
| 6,170,962 B1 | | 1/2001 | Wordin | |
| 6,273,592 B1 | | 8/2001 | Herst et al. | |
| 2002/0003699 A1 | | 1/2002 | Shemitz et al. | |
| 2002/0105807 A1 | | 8/2002 | Loughrey | |
| 2002/0172044 A1 | | 11/2002 | Perlo et al. | |

* cited by examiner

*Primary Examiner*—Thomas M. Sember
*Assistant Examiner*—Hargobind S Sawhney
(74) *Attorney, Agent, or Firm*—Mark S. Bicks; Alfred N. Goodman

(57) ABSTRACT

A luminaire having a frame that includes opposite first and second ends with a connecting member extending therebetween. The frame has an opening remote from the connecting member. First and second lamps are supported by the frame adjacent the first and second ends, respectively. A main reflector extends between the first and second ends of the frame and has a reflecting surface directed towards the opening of the frame. First and second reflecting members are disposed adjacent the first and second ends, respectively, of the frame and between the first and second lamps, respectively, and the opening of the frame. Each of the first and second reflecting members includes first and second curved reflectors and a plurality of baffles extending between the first and second curved reflectors. The first and second reflecting members direct light from the first and second lamps, respectively, through the opening in the frame.

26 Claims, 2 Drawing Sheets

LUMINAIRE PROVIDING DIRECT AND INDIRECT LIGHTING

FIELD OF THE INVENTION

The present invention relates to a luminaire that provides both direct and indirect lighting through elongated reflecting members and a main reflector for delivering a uniform illumination. More specifically, each reflecting member is a louver extending along the luminaire sides and the main reflector extends between the luminaire sides.

BACKGROUND OF THE INVENTION

Conventional recessed lighting fixtures for retail and industrial applications often provide uneven illumination creating undesirable hot spots and glare. This uneven illumination also decreases the efficiency of the fixture due to the lack of optical control. Typically this occurs with conventional fixtures that use straight blades or reflectors coated with reflective material, such as white paint, which merely scatter the light instead of precisely controlling the light. Other conventional lighting fixtures provide more control of the light but fail to provide a uniform illumination.

Examples of conventional lighting fixtures and luminaires include U.S. Pat. No. 6,273,592 to Herst et al.; U.S. Pat. No. 6,170,962 to Wordin; U.S. Pat. No. 5,988,829 to Holder; U.S. Pat. No. 5,884,994 to Herst et al.; U.S. Pat. No. 5,709,460 to Lester; U.S. Pat. No. 5,685,633 to Engel; U.S. Pat. No. 5,528,478 to Degelmann; U.S. Pat. No. 4,517,631 to Mullins; and U.S. Pat. No. 3,591,798 to Florence, and U.S. patent application Publication Nos. 2002/0105807 to Loughrey and 2002/0003699 to Shemitz et al, of the subject matter of each of which is hereby incorporated by reference.

SUMMARY OF THE INVENTION

Accordingly, an object of the present invention is to provide a luminaire that furnishes a uniform illumination.

Another object of the present invention is to provide a luminaire that both directly and indirectly reflects light.

Yet another object of the present invention is to provide a luminaire that has an aesthetic design and is high performing.

Still another object of the present invention is to provide a luminaire that precisely controls the light while also reducing glare.

The foregoing objects are basically attained by a luminaire having a frame that includes opposite first and second ends with a connecting member extending therebetween. The frame has an opening remote from the connecting member. First and second lamps are supported by the frame adjacent the first and second ends, respectively. A main reflector extends between the first and second ends of the frame and has a reflecting surface directed towards the opening of the frame. First and second reflecting members are disposed adjacent the first and second ends, respectively, of the frame and between the first and second lamps, respectively, and the opening of the frame. Each of the first and second reflecting members includes first and second curved reflectors and a plurality of baffles extending between the first and second curved reflectors. The first and second reflecting members direct light from the first and second lamps, respectively, through the opening in the frame.

The foregoing objects are also attained by a luminaire having a frame that includes opposite first and second ends and opposite third and fourth ends extending between the first and second ends. The frame has an opening. First and second lamps are supported by the frame adjacent the first and second ends, respectively. A main reflector extends between and is coupled to the first and second ends of the frame and has a reflecting surface directed towards the opening of the frame. First and second reflecting members are disposed adjacent the first and second ends, respectively, of the frame and spaced from the main reflector. Each of the first and second reflecting members includes first and second curved reflectors extending from the third end to the fourth end of the frame. A plurality of baffles extend between the first and second curved reflectors. The main reflector and the first and second reflecting members direct light from the first and second lamps, respectively, through the opening in the frame.

The foregoing objects are also attained by a luminaire having a frame including opposite first and second ends connected by a wall. The frame has an opening remote from the wall. First and second lamps supported by the frame adjacent the first and second ends, respectively. A first diffuser is coupled to the frame. A main reflector extends between and is coupled to the first and second ends of the frame and disposed between the wall of the frame and the diffuser. The main reflector having a reflecting surface directed towards the opening of the frame. First and second reflecting members are disposed adjacent the first and second ends, respectively, of the frame and between the main reflector and the opening of the frame. Each of the first and second reflecting members includes first and second curved reflectors extending substantially the entire length of the first and second ends, respectively. A plurality of baffles extend between the first and second curved reflectors. The main reflector and the first and second reflecting members direct light from the first and second lamps, respectively, through the opening in the frame.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE PREFERRED EMBODIMENT

Figure 2:
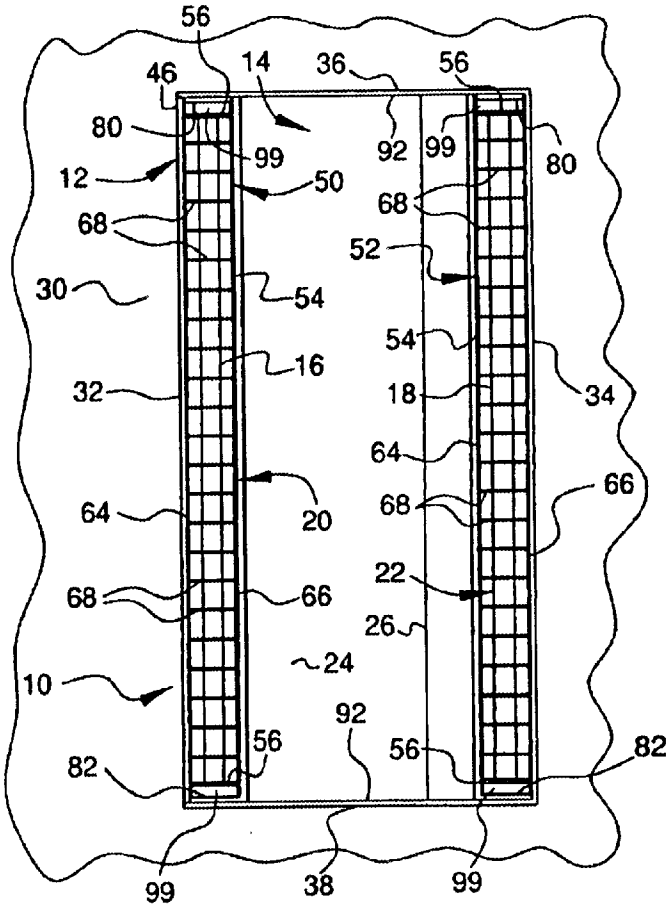
FIG. 2 is a bottom plan view of the luminaire illustrated in FIG. 1.

Referring to FIGS. 1–5, a luminaire 10 in accordance with the preferred embodiment generally includes a frame 12 that supports a main reflector 14, first and second lamps 16 and 18, and first and second reflecting members 20 and 22. First and second reflecting members 20 and 22 precisely direct light emitted from lamps 16 and 18 through openings of reflecting members 20 and 22, respectively, corresponding to a main opening 28 in frame 12. This precise optical control increases efficiency of luminaire 10 and reduces glare. Main reflector 14 indirectly reflects light from lamps 16 and 18 through frame main opening 28. First and second diffusers 24 and 26 can optionally be included with luminaire 10.

Figure 1:
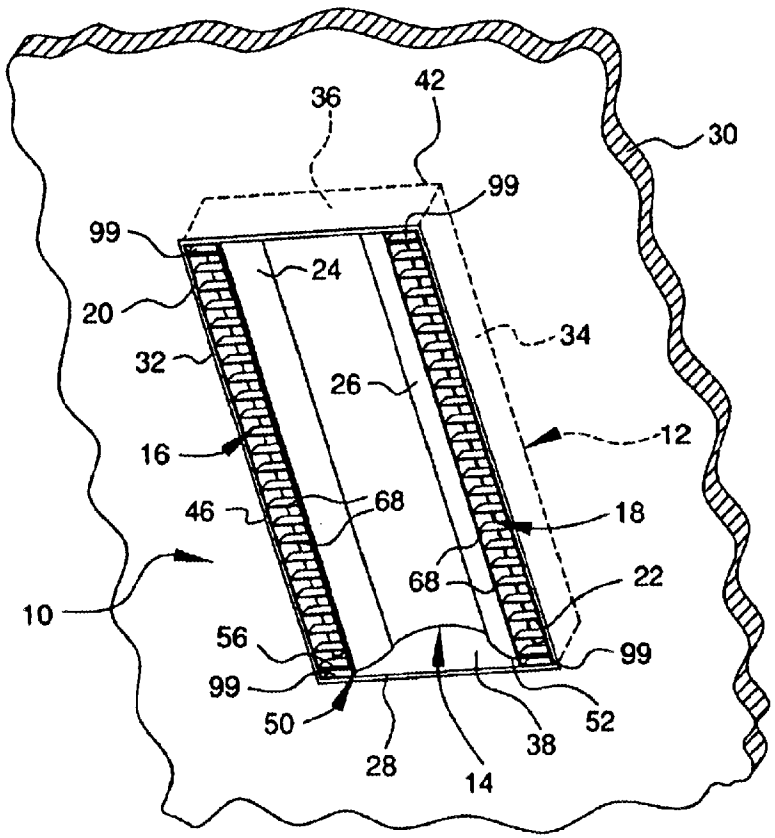
FIG. 1 is a bottom perspective of the luminaire in accordance with a preferred embodiment of the invention, showing the luminaire recessed in a support.

Luminaire 10 is preferably recessed in a support structure 30, such as a ceiling, so that frame main opening 28 aligns with an opening 31 in ceiling 30, as seen in FIG. 1. First and second reflecting members 20 and 22 and main reflector 14 direct light downwardly below ceiling 30. Alternatively, luminaire 10 can be mounted to ceiling 30 or mounted on any wall or pole.

Figure 3:
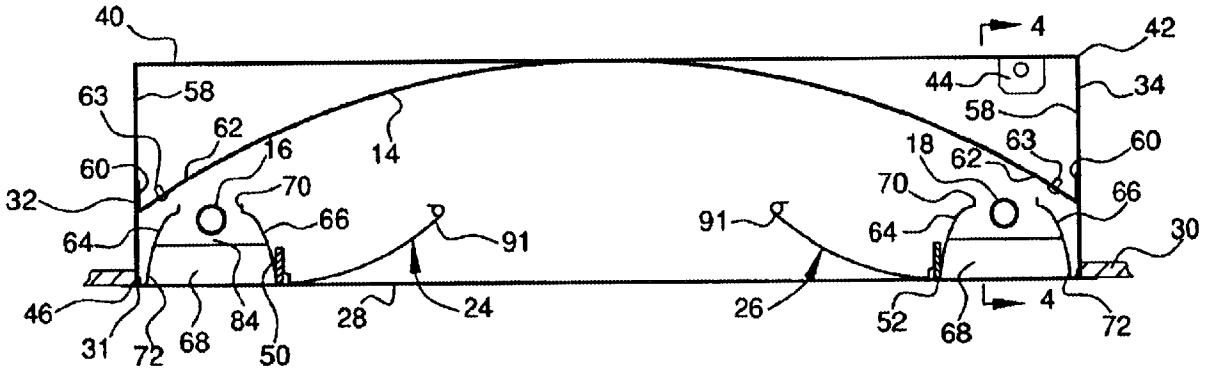
FIG. 3 is a side elevational view in section of the luminaire illustrated in FIG. 1, showing first and second reflecting members supported in a frame.
Figure 5:
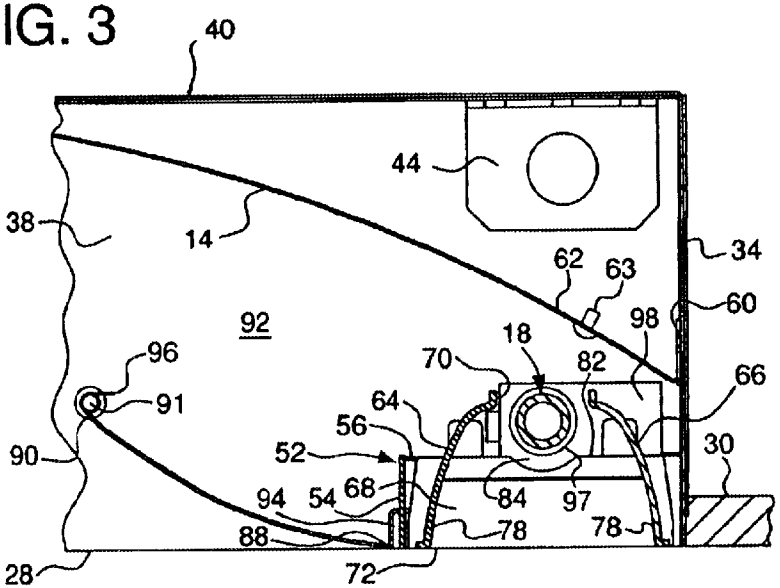
FIG. 5 is an enlarged partial side elevational view in section of the luminaire illustrate in FIG. 1, showing one of the reflecting members.

As seen in FIG. 1, frame 12 includes opposite first and second ends 32 and 34 that extend between opposite third and fourth ends 36 and 38. First and second ends 32 and 34 are preferably longer than third and fourth ends 36 and 38, thereby forming a substantially rectangular-shaped frame 12. Alternatively, first and second ends 32 and 34 can have a length that is equal to or less than third and fourth ends 36 and 38. A connecting member 40 connects each of the ends 32, 34, 36 and 38 remote from frame opening 28. Ends 32, 34, 36 and 38 and connecting member 40 are preferably walls, thereby forming a housing 42 for lamps 16 and 18, main reflector 14 and first and second reflecting members 20 and 22, as seen in FIGS. 1 and 3. However, ends 32, 34, 36 and 38 are not required to be walls and can be other structures, such as brackets. Frame 12 also preferably supports a ballast 44 between main reflector 14 and connecting member 40, as best seen in FIG. 5. Extending around the perimeter of main opening 28 of frame 12 is an aesthetic trim 46 that borders ceiling opening 31 when luminaire 10 is recessed in ceiling 30.

As seen in FIG. 2, first and second brackets 50 and 52 are disposed adjacent first and second ends 32 and 34, respectively, of frame 12 for supporting first and second reflecting members 20 and 22. Each bracket 50 and 52 includes a longitudinal section 54 that is substantially parallel with first and second ends 32 and 34 and substantially perpendicular TO arms 56 at each end of longitudinal section 54, as best seen in FIGS. 2 and 5. Arms 56 of each bracket 50 and 52 are attached to the inner surfaces 58 of frame first and second ends 32 and 34, respectively, by any conventional manner, such as a welding or fastener attachment. Longitudinal section 54 extends between arms 56 and defines a space between first and second ends 32 and 34 that is sized to accommodate first and second reflecting members 20 and 22, respectively.

As seen in FIG. 3, main reflector 14 preferably has an arcuate shape in cross-section and attaches to the inner surfaces 58 of frame first and second ends 32 and 34. Preferably, V-shaped brackets 60 extending from inner surfaces 58 of both first and second ends 32 and 34 engage opposite end edges 62 of main reflector 14 via fasteners 63, as best seen in FIGS. 3 and 5. However, any known attachment can be used to secure main reflector 14 to inner surfaces 58, such as a welding or snap attachment.

First and second reflecting members 20 and 22 are preferably louvers that precisely direct the light from lamps 16 and 18, as best seen in FIGS. 1 and 2. Reflecting members 20 and 22 each include first and second curved reflectors 64 and 66 and a plurality of baffles 68 extending between curved reflectors 64 and 66. Curved reflectors 64 and 66 of each reflecting member 20 and 22 are preferably substantially parallel to one another and parallel to first and second lamps 16 and 18, respectively. Each curved reflector 64 and 66 extends substantially the entire length of frame first and second ends 32 and 34 between third and fourth ends 36 and 38. Curved reflectors 64 and 66 of each reflecting member 20 and 22 have a substantially parabolic shape in cross section, as seen in FIGS. 3 and 5, converging at one end to form a first open channel 70 for accommodating at least a portion of respective lamps 16 and 18. Depending on the size and type of lamp, a greater or lesser portion of a respective lamp 16 and 18 will be received in a respective first open channel 70. A second open channel 72 is defined between first and second curved reflectors 64 and 66 opposite first open channel 70. Second open channel 72 is substantially wider in cross section than first open channel 70 and forms part of frame main opening 28 for allowing light to be directed therethrough.

Figure 4:
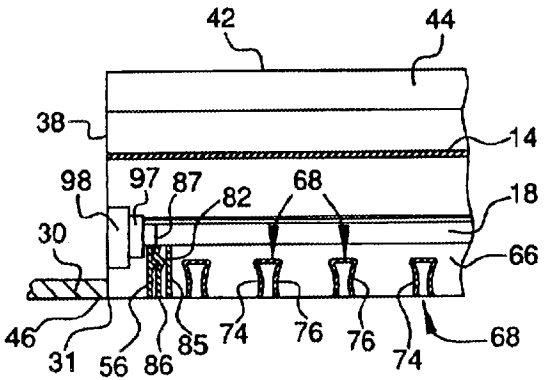
FIG. 4 is a partial side elevational view taken in section along lines 4—4 of FIG. 3.

Baffles 68 extending between curved reflectors 64 and 66 and are generally parallel with third and fourth frame ends 36 and 38, as best seen in FIGS. 1–3. Each baffle 68 is preferably formed of opposite first and second curved pieces 74 and 76 and are substantially evenly spaced from one another, as seen in FIG. 4. Each baffle 68 preferably extends about half the height of curved reflectors 64 and 66, as seen in FIG. 3, thereby leaving a gap 84 between lamps 16 and 18 and baffles 68. The sides 78 of each baffle 68 preferably match the curvature of curved reflectors and are attached to the inner surfaces thereof in any conventional manner.

First and second end baffles 80 and 82 are included with each reflecting member 20 and 22 which cap or close off the ends of each reflecting member 20 and 22, as best seen in FIGS. 2 and 5. Attached to each end baffle 80 and 82 is a spring metal clip 86 allowing a releasable engagement of reflecting members 20 and 22 on first and second brackets 50 and 52, respectively, thereby supporting reflecting members 20 and 22 within frame 12. Each spring clip 86 includes an offset portion 85 that engages a protrusion 87 extending inwardly from arm 56 of each bracket 50 and 52 of each reflecting member 20 and 22, respectively, as seen in FIG. 4.

As seen in FIG. 1, first and second diffusers 24 and 26 extend between frame third and fourth ends 36 and 38 and are substantially parallel to one another, Diffusers 24 and 26 are releasably coupled at one side 88 to longitudinal sections 54 of each of first and second brackets 50 and 52, and at a second side 90 to third and fourth frame ends 36 and 38 by pins 91 extending from the inner surfaces 92 of ends 36 and 38. Side 88 of each diffuser 24 and 26 includes a clip 94 that rotatably engages a corresponding slot or hole in longitudinal section 54. Second side 90 of each diffuser 24 and 26 includes a hook end 96 for engaging pins 91 extending from third and fourth ends 36 and 38, as best seen in FIG. 5 (showing a single pin 91 extending from fourth end inner surface 92).

Each diffuser 24 and 26 is preferably a metal panel, such as aluminum, that is perforated for diffusing light. Diffusers 24 and 26 extend from brackets 50 and 52, respectively, toward one another and curve towards main reflector 14 and frame connecting member 40, thereby diffusing light as it reflects from main reflector 14, as seen in FIG. 3. Diffusers 24 and 26 can optionally include a plastic overlay for additional diffusion of light.

Lamps 16 and 18 are preferably fluorescent, such as T-5 fluorescent lamps. Each lamp 16 and 18 is connected to a lamp holder or socket 97 disposed on the inner surfaces 92 of each of third and fourth ends 36 and 38 of frame 12 by a pan 98, as seen in FIG. 4, as is well known in the art. Lamp holder 97 can alternatively be designed to support more than one lamp. Pan 98 may lie on the opposite side of third and fourth ends 36 and 38 depending on the length of the lamp being used. To hide lamp holder 97 and pan 98, metal plates 99 can be added to each end of reflecting members 20 and 22, as seen in FIGS. 1 and 2. Metal plates 99 extend from arms 56 of brackets 50 and 52 toward frames ends 36 and 38, respectively.

Referring to FIGS. 1–5, luminaire 10 is preferably mounted in ceiling 30 such that luminaire 10 is recessed in ceiling 30, as is well known in the art. Frame 12 is inserted through ceiling opening 31 until trim 46 abuts ceiling 30 and frame opening 28 is contiguous with ceiling opening 31. Main reflector 14 is releasably attached to the inner surfaces 58 of frame first and second ends 32 and 34, respectively, by V-shaped brackets 60 and fasteners 63. First and second lamps 16 and 18 are inserted into lamp holders 97 disposed on the inner surfaces 92 of frame third and fourth ends 36 and 38 so that lamps 16 and 18 are parallel to one another and disposed next to frame first and second ends 32 and 34, respectively.

First and second reflecting members 20 and 22 are assembled separately and then mounted into frame 12. Each reflecting member 20 and 22 is assembled by attaching the plurality of baffles 68 between first and second curved reflectors 64 and 66 and attaching first and second end baffles 80 and 82 to opposing ends of first and second curved reflectors 64 and 66. Once assembled, first and second reflecting members 20 and 22 are inserted through frame opening 26 and mounted in frame 12 in the spaces defined between the longitudinal sections 54 of brackets 50 and 52, respectively, and frame ends 32 and 34. Spring clips 86 of each end baffle 80 and 82 of each reflecting member 20 and 22 engage arms 56 of brackets 50 and 52, respectively. As each reflecting member 20 and 22 is inserted through frame opening 28, each spring clip 86 is biased inwardly to clear protrusion 87 of arm 56 of respective brackets 50 and 52 until protrusion 87 catches the offset portion 85 of each spring clip 86, thereby releasably engaging reflector members 20 and 22 and brackets 50 and 52. Although spring clips 86 are preferably used to mount reflecting members 20 and 22 into frame 12, any conventional engagement can be employed, such as fasteners or torsional spring, or friction fit or hinge and latch arrangement.

First and second diffusers 24 and 26 are releasably mounted to brackets 50 and 52, respectively, by rotatably inserting clips 94 of side 88 of each diffuser into corresponding holes in longitudinal sections 54 of brackets 50 and 52. The hook ends 96 on the opposite sides 90 of each diffuser 24 and 26 can then be hooked to pins 91 extending from the inner surfaces 92 of frame third and fourth ends 36 and 38, so that diffusers 24 and 26 are spaced from main reflector 14 and are adjacent first and second reflecting members 20 and 22, respectively.

A uniform illumination from lamps 16 and 18 is provided by a combination of first and second reflecting members 20 extending along the ends of frame 12 for precisely and efficiently directing the light from lamps 16 and 18 through open channels 72 and frame opening 28, and main reflector 14 reflecting the light toward and through frame opening 28. Diffusers 24 and 26 provide additional spreading of the light, however, diffusers 24 and 26 are not required.

While a particular embodiment has been chosen to illustrate the invention, it will be understood by those skilled in the art that various changes and modifications can be made therein without departing from the scope of the invention as defined in the appended claims.

What is claimed is:

1. A luminaire, comprising:

a frame including opposite first and second ends with a connecting member extending therebetween, said frame having an opening remote from said connecting member;

first and second lamps supported by said frame adjacent said first and second ends, respectively;

a main reflector extending between said first and second ends of said frame and having a reflecting surface directed towards said opening of said frame; and first and second reflecting members disposed adjacent said first and second ends, respectively, of said frame and between said first and second lamps, respectively, and said opening of said frame, each of said first and second reflecting members including first and second curved reflectors and a plurality of baffles extending between said first and second curved reflectors, said first and second reflecting members directing light from said first and second lamps, respectively, through said opening in said frame.

2. A luminaire according to claim 1, wherein each of said first and second reflecting members are open remote from said first and second lamps, thereby allowing light to emit through said first and second reflecting members and through said opening in said frame.

3. A luminaire according to claim 1, wherein said first and second curved reflectors of each of said first and second reflecting members form open channels for receiving at least a portion of said first and second lamps, respectively.

4. A luminaire according to claim 1, wherein said first and second curved reflectors of each of said first and second reflecting members converge toward said first and second lamps, respectively.

5. A luminaire according to claim 4, wherein said first and second curved reflectors of each of said first and second reflecting members have a substantially parabolic shape in cross section.

6. A luminaire according to claim 1, wherein said main reflector has an arcuate shape and is a coupled to said first and second ends of said frame.

7. A luminaire according to claim 1, wherein said first and second reflecting members are parallel to said first and second lamps.

8. A luminaire according to claim 1, wherein substantially the entire first reflecting member and substantially the entire second reflecting member are disposed between said first and second lamps, respectively, and said opening in said frame.

9. A luminaire according to claim 1, wherein said first and second lamps arc fluorescent lamps.

10. A luminaire, comprising:

a frame including opposite first and second ends and opposite third and fourth ends extending between said first and second ends, said frame having an opening;

first and second lamps supported by said frame adjacent said first and second ends, respectively;

a main reflector extending between and coupled to said first and second ends of said frame and having a reflecting surface directed towards said opening of said frame; and first and second reflecting members disposed adjacent said first and second ends, respectively, of said frame and spaced from said main reflector, each of said first and second reflecting members including first and second curved reflectors extending from said third end to said fourth end of said frame, and a plurality of baffles extending between said first and second curved reflectors, said main reflector and said first and second reflecting members directing light from said first and second lamps, respectively, through said opening in said frame.

11. A luminaire according to claim 10, wherein each of said first and second reflecting members are open remote from said first and second lamps, thereby allowing light to emit through said first and second reflecting members and through said opening in said frame.

12. A luminaire according to claim 10, wherein substantially the entire first reflecting member and substantially the entire second reflecting member are disposed between said first and second lamps, respectively, and said opening in said frame.

13. A luminaire according to claim 10, wherein said first and second curved reflectors of each of said first and second reflecting members have a substantially parabolic shape in cross section.

14. A luminaire according to claim 10, wherein said plurality of baffles are substantially parallel to said third and fourth ends of said frame.

15. A luminaire according to claim 10, wherein said first and second reflecting members are substantially parallel to said first and second lamps.

16. A luminaire according to claim 10, wherein said first, second, third and fourth ends are connected by a wall to form a housing for supporting said main reflector, said first and second lamps and said first and second reflecting members.

17. A luminaire according to claim 10, wherein said main reflector has an arcuate shape.

18. A luminaire according to claim 10, wherein said first and second lamps are fluorescent lamps.

19. A luminaire, comprising:

a frame including opposite first and second ends connected by a wall, said frame having an opening remote from said wall;

first and second lamps supported by said frame adjacent said first and second ends, respectively;

a first diffuser coupled to said frame;

a main reflector extending between and coupled to said first and second ends of said frame and disposed between said wall of said frame and said diffuser, said main reflector having a reflecting surface directed towards said opening of said frame; and first and second reflecting members disposed adjacent said first and second ends, respectively, of said frame and between said main reflector and said opening of said frame, each of said first and second reflecting members including first and second curved reflectors extending substantially the entire length of said first and second ends, respectively, and a plurality of baffles extending between said first and second curved reflectors, said main reflector and said first and second reflecting members directing light from said first and second lamps, respectively, through said opening in said frame.

20. A luminaire according to claim 19, wherein said first diffuser is adjacent said first reflecting member.

21. A luminaire according to claim 20, wherein a second diffuser is coupled to said frame; and said second diffuser is adjacent said second reflecting member.

22. A luminaire according to claim 19, wherein said first and second ends of said frame extend between opposite third and fourth ends forming a housing for supporting said main reflector, said first and second lamps, and said first and second reflecting members.

23. A luminaire according to claim 19, wherein each of said first and second reflecting members are open remote from said first and second lamps, thereby allowing light to emit through said first and second reflecting members and through said opening in said frame.

24. A luminaire according to claim 19, wherein substantially the entire first reflecting member and substantially the entire second reflecting member are disposed between said first and second lamps, respectively, and said opening in said frame.

25. A luminaire according to claim 19, wherein said first and second reflecting members are parallel to said first and second lamps.

26. A luminaire according to claim 19, wherein said main reflector has an arcuate shape.

* * * * *